US005160259A

United States Patent [19]

O'Hara et al.

[11] Patent Number: 5,160,259

[45] Date of Patent: Nov. 3, 1992

[54] DRAFT CONTROL METHOD AND APPARATUS FOR MATERIAL PROCESSING PLANTS

[75] Inventors: John O'Hara, Annville; Fred L. Fuhrman, Jonestown; David R. Wolfe, Lititz; Bruce C. Irwin, Palmyra, all of Pa.

[73] Assignee: Hauck Manufacturing Company, Lebanon, Pa.

[21] Appl. No.: 694,257

[22] Filed: May 1, 1991

[51] Int. Cl.[5] ..... F27B 9/40; F23N 5/00

[52] U.S. Cl. ..... 432/37; 236/15 E; 431/76

[58] Field of Search ..... 432/37; 110/162, 163; 236/15 E; 431/76, 12

[56] References Cited

U.S. PATENT DOCUMENTS

| | | | |
|---|---|---|---|
| 3,366,374 | 1/1968 | Bay et al. . | |
| 3,401,923 | 9/1968 | Bearce . | |
| 3,514,085 | 5/1970 | Woock | 431/76 X |
| 3,566,091 | 2/1971 | Lansdale et al. . | |
| 3,578,299 | 5/1971 | Hurlbut | 437/76 X |
| 3,595,544 | 7/1971 | Curtis et al. . | |
| 3,884,621 | 5/1975 | Summer | 432/19 |
| 4,002,421 | 1/1977 | Summer | 432/19 |
| 4,253,404 | 3/1981 | Leonard | 236/15 E |
| 4,360,336 | 11/1982 | Shepherd | 431/12 |
| 4,362,269 | 12/1982 | Rastogi et al. | 236/15 E |
| 4,362,499 | 12/1982 | Nethery | 431/12 |
| 4,421,473 | 12/1983 | Londerville | 431/76 |
| 4,492,559 | 1/1985 | Pocock | 431/12 |

*Primary Examiner*—William E. Wayner
*Attorney, Agent, or Firm*—Finnegan, Henderson, Farabow, Garrett & Dunner

[57] ABSTRACT

A draft control for material processing apparatus, such as asphalt plants, having a chamber through which material to be processed is passed for contact with combustion gases and heat originating in a fuel supplied burner which may require a draft to draw air into the chamber for complete combustion of burner supplied fuel and to exhaust the products of combustion and other gaseous materials from the chamber. The air pollutants and the percent oxygen in the exhausted gases are monitored, and the draft is adjusted between minimum and maximum values for a given burner set point when the air pollutant content of the stack gases exceeds a predetermined maximum limit. The direction of draft adjustment is determined by the percent oxygen in the exhaust gases.

11 Claims, 2 Drawing Sheets

DRAFT CONTROL METHOD AND APPARATUS FOR MATERIAL PROCESSING PLANTS

BACKGROUND OF THE INVENTION

1. Field of the Invention

This invention relates to an emission monitoring and control system for material processing apparatus and, more particularly, it concerns a method and apparatus for adjusting the draft of a burner fired material treatment apparatus, such as an asphalt plant, in a manner to optimize burner efficiency and maintain air pollutants within the established limits.

2. Description of the Related Art

In a typical asphalt plant, a process material such as crushed stone aggregate is heated during continuous movement of the material through a rotary drum either prior to or during mixture with various tars and other asphaltic materials. Heat is supplied by an oil or gas burner located at one end of the drum and oriented to bring the products of combustion emanating from the burner into direct contact with the process material contained in the drum. The products of combustion, water vapor and other air suspended materials are withdrawn from the end of the rotary drum opposite from the burner by draft fan in an exhaust system which includes gas cleaning devices such as a cyclone separator for removing solid particulate materials, fabric filters and the like.

The burners used in such plants are usually fueled by oil, natural gas or liquefied gas and in some cases a combination of oil and natural gas or of natural gas and liquefied gas. They have self contained blowers that supply between 40% and 125% of stoichiometric air required for complete combustion. In the case where less than 125% of the air is supplied by the burner blower or blowers, the remaining air must be induced into the combustion zone by the negative pressure developed by the exhaust fan, the quantity etc. The quantity of air drawn in by draft, however, is the product of many unpredictable variables, such as leakage openings between the drum and the draft fan, of which there are many, filter blockages and the like. Also in the operation of such plants, burner firing rate is modulated primarily, if not exclusively, by the processing demand of the plant. If the plant is operated to dry process material, for example, the burner firing rate will vary with the water content of the process material as well as with the rate of processing material feed through the drum. Burner firing rate modulation is effected by varying the fuel supplied to the burner. In cases where less than stoichiometric air is supplied by burner blowers, the air supply is controlled to a limited extent by the burner air damper while the remaining air plus any desired excess air has had limited control usually by maintaining a constant negative pressure within the drum. While total air burners attempt to modulate the required air, to date this had been difficult to achieve without the benefit of oxygen analyzers.

It will be appreciated, therefore, that the nature of operation and the general arrangement of components in burner fired material processing apparatus represented by asphalt plants are not suited for maintaining precise control of air/fuel ratios in the combustion process associated with such apparatus. The proportions of air and fuel in that combustion process, moreover, determine the quantity of combustible air pollutants, such as carbon monoxide, discharged as stack gases to the atmosphere. As a results, asphalt and similar material processing plants have become the subject of numerous regulations directed to avoiding pollution of the atmosphere. Thus, there is a need for improvements in such apparatus by which the air pollutants exhausted to the atmosphere are kept within acceptable limits without sacrifice in material processing capacity or in the economic advantages of existing plants.

SUMMARY OF THE INVENTION

A principal object of the invention is the provision of an improved draft control method and apparatus for burner fired material processing systems.

Another object of the invention is to provide such a method and apparatus by which air pollutants contained in the exhaust gases of such systems may be maintained within acceptable limits while optimizing fuel burning efficiency.

A further object of the invention is the provision of such a method and apparatus particularly, though not exclusively, suited to maintaining the carbon monoxide content in the exhaust gases of such systems within acceptable and/or regulated limits.

A still further object of the invention is to provide such a method and apparatus by which measured and calculated values of stack gas contents affecting air pollution and combustion efficiency are recorded.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a method for processing material in which the combustion products of fuel supplied to a burner are drawn by induced draft into heat exchange relation with the material being processed and exhausted as stack gases, the rate of fuel supply to the burner being determined by a burner set point corresponding to heat required for processing the material, the method including the steps of modulating the burner set point as required for processing the material, monitoring the air pollutant content of the stack gases, monitoring the oxygen content of the stack gases, and varying the draft between minimum and maximum values for a given burner set point when the air pollutant content of the stack gases exceeds a predetermined maximum limit.

The invention is also embodied in an apparatus adapted to be used in a material processing plant having a chamber through which material to be processed is passed for contact with combustion gases and heat originating in a fuel supplied burner which may require a draft to draw air into the chamber for complete combustion of burner supplied fuel as well as to withdraw products of combustion and other gaseous materials as stack gases, the invention comprising a sensor for measuring the air pollutant content of the stack gases, a sensor for measuring the percent oxygen in the stack gases, and a provision for varying the draft to maintain the level of air pollutants in the stack gases within acceptable levels and to optimize fuel combustion in response to processed measurements by the sensors.

It is to be understood that both the foregoing general description and the following detailed description are exemplary and explanatory only and are not restrictive of the invention, as claimed.

The accompanying drawings, which are incorporated in and constitute a part of this specification, illustrate one (several) embodiment(s) of the invention and together with the description, serve to explain the principles of the invention.

DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

Figure 1:
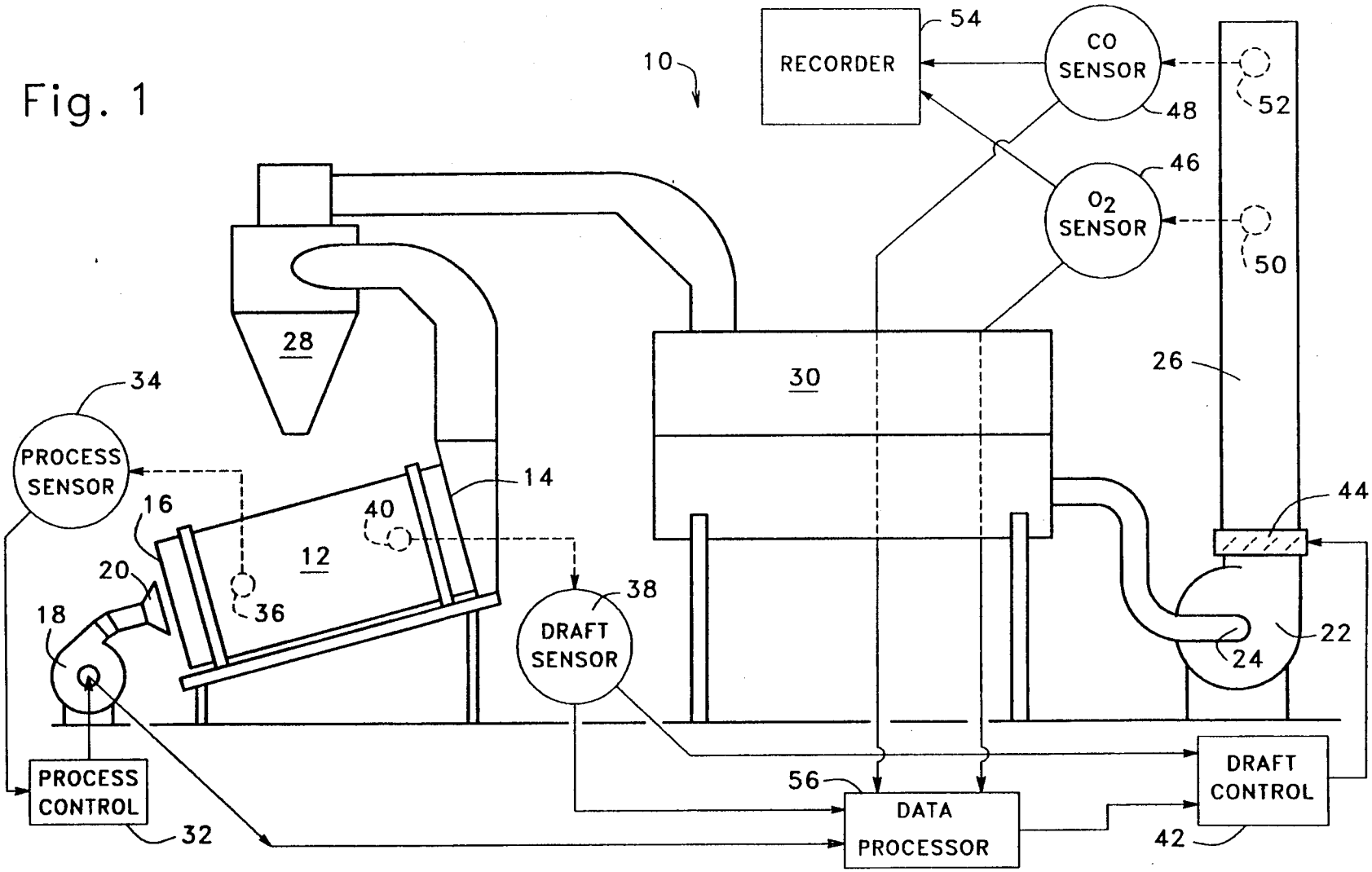
FIG. 1 is a schematic representation of a material processing apparatus in which the present invention is especially suited for use.

In FIG. 1 of the drawings, a burner fired material processing apparatus is generally designated by the reference numeral 10 and shown to incorporate components commonly used in asphalt plants. As such, the apparatus 10 includes a processing chamber defined in the illustrated embodiment by an inclined rotary drum 12 through which material (not shown) to be processed is continuously advanced by gravity from an elevated end 14 to a lower open end 16 of the drum 12. A motorized burner 18 having a discharge nozzle 20 is positioned to direct a flame of burning fuel, such as oil or gas or a combination thereof supplied to the burner 18, into the open end 16 of the drum 12. FIG. 1 depicts a counter flow drum where the material flows counter to the products of combustion. The invention would be equally applied to a parallel flow system where material flow would be parallel to the flow of the products of combustion. In such cases the drum is inclined opposite to the counter flow drum with material entering the burner end and exiting the other end.

To assure movement of gaseous and gas suspended materials through the drum 12, the interior of the drum 12 is maintained under a negative pressure by a draft developed by a motor driven fan 22 having an intake 24 and discharging to an exhaust gas stack 26. Components typically provided between the drum 12 and the draft fan intake 22 includes a cyclone separator 28 and a fabric filter 30 for removal of particulate solids suspended in gas passing from the drum 12 and prior to the discharge of exhaust gases to the atmosphere from the stack 26.

In asphalt plant applications, the components of the apparatus 10 thus far described are conventionally used to dry and heat process materials, such as crushed stone aggregate, passed through the drum 12 either prior to or during mixture of the aggregate with asphaltic materials. The process material is heated essentially by direct contact with the hot combustion products from the burner 18. The burner 18 is controlled by a process control module 32 to vary or modulate the firing rate of the burner in accordance with the demand for heat by the process material in the drum. The demand for heat is determined by a process sensor 34 which generates a signal corresponding to a process parameter, typically temperature, detected at a probe 36 located in the drum 12. In an aggregate drying operations, for example, the temperature of the aggregate will vary with water content, density, rate of feed and the like, thus often requiring constant modulation of the burner firing rate.

Also, the burner 18 in itself, is conventional and as such, includes a blower or blowers (not shown) for supplying air to mix with the fuel and project a flame of burning fuel into the drum 12. The air thus supplied by the burner 18, however, could be substantially less than the air required for complete combustion of fuel directed form the burner into the drum. For example, the air supplied by the burner 18 may be as little as 40% of the air required for stoichiometric combustion of the supplied fuel. In such cases, the remaining air requirements for combustion must be induced through the burner breech ring at the end 16 of the drum 12 as a result of the draft developed by the fan 22. Thus, the fuel combustion efficiency and the products resulting from such fuel combustion are dependent in substantial measure on the draft of the system.

In cases where all the air required for stoichiometric combustion of fuel is supplied by the burner blower or blowers, control of the exhaust draft becomes critical in reducing tramp air that may be introduced into the process by leakage between the drum 12 and the exhaust fan 22. Exhaust draft control in this latter case is also important to maintain a continuous flow through the plant while maintaining optimal flow velocities. Reduced flow velocities decrease the amount of material entrained in the flowing gases as well as power required by the fan 22.

In accordance with the present invention, means are provided for monitoring the draft in terms of negative pressure in the chamber containing material being processed, the air pollutant content of stack gases and the oxygen content of stack gases and for varying the draft as necessary to maintain the air pollutant content with acceptable limits. Thus, in the illustrated embodiment, a draft sensor 38, having a probe 40 located in the drum 12, is provided for developing a signal corresponding to the negative pressure within the drum 12. The signal provided by the draft sensor is fed to a draft control module 42 which, in turn, controls a draft damper 44 located between the discharge of the fan 22 and the stack 26. In addition, an oxygen ($O_2$) sensor 46 and a carbon monoxide (CO) sensor 48 are provided, each having respective detecting probes 50 and 52 located in the exhaust gas stack 26. The sensors 46 and 48 supply measurements of stack gas carbon monoxide and oxygen content to a recorder 54 and to a data processor 56. The data processor is also supplied with signal from the draft sensor 38 and with a signal corresponding to the firing rate of the burner 18 in a manner to be described in more detail below.

Figure 2:
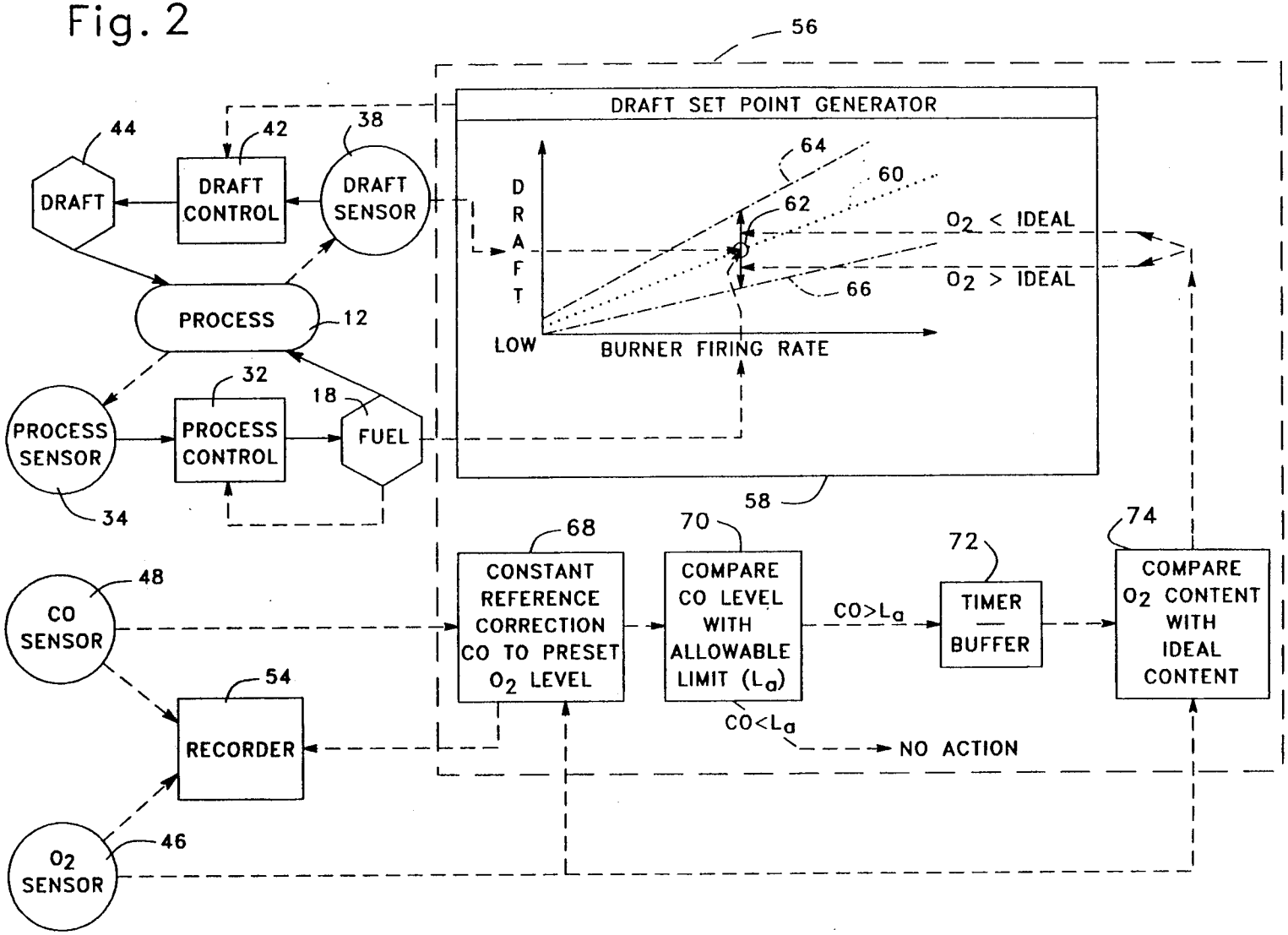
FIG. 2 is a logic flow diagram depicting operation of the present invention.

In FIG. 2 of the drawings, processing details of the data processor 56 are shown in relation to components previously identified in FIG. 1 but illustrated in schematic form on FIG. 2 and designated by the same reference numerals. The data processor 56 includes a draft set point generator 58 by which draft air, as regulated by the draft control 42, is varied directly with burner firing rate in a proportion represented by the slope of a line 60. Thus, as the firing rate of the burner 1B is varied with respect to a given set point, represented in FIG. 2 by a circle 62, to satisfy material processing demands determined by the process sensor 34, the draft control 42 is commanded by the draft set point generator 58 to vary the draft damper 44 to maintain a linear draft/firing rate ratio represented by the slope of the line 60.

The slope of the line 60 is selected to lie approximately midway between lines 64 and 66 which represent respectively, the maximum and minimum limits of draft variation for material processing operation of the apparatus 10. For example, a draft set point below the minimum represented by the line 66 would result in a pressure build-up in the burner flame front manifested as a puffing action at the burner 18. A draft set point above the maximum for a giver burner set point, as represented by the line 64, develops air flow velocities in the drum 12 at which particles of the process material begin to be picked up.

Draft/firing rate ratios falling between the lines 64 and 66 are acceptable from the standpoint of attaining the intended material processing operation of the apparatus 10. However, from the standpoint of obtaining optimal fuel efficiency and from the standpoint of maintaining the level of combustible air pollutants, such as carbon monoxide, within acceptable or regulated limits in the stack 26, additional trim of the draft/firing rate ratio is required.

Other data processing modules in the processor 56 are represented in FIG. 2 by a series of legends and blocks between the oxygen and carbon monoxide sensors 46, 48 and the draft set point generator 58 and which include a constant reference correction module 68 to which signals from the sensor 48 representing the quantity of air pollutant in the gases exhausted from the stack 26, in this instance carbon monoxide, and from the oxygen sensor 46 are fed. In the module 68, the measured CO content in the stack 26 is converted to a value referenced to air. The conventional unit of measurement for an air pollutant such as carbon monoxide is parts per million (ppm) with reference usually to clean air of which the percent oxygen is 20.9%. To reference the carbon monoxide content discharged into the atmosphere from the stack 26, therefore, and to avoid measurements influenced by varying oxygen levels in the stack 26, the measured CO content is referenced to a predetermined oxygen content in the stack gases usually established by a regulatory agency. For example, if the sensor 48 indicates a measured CO content in the stack 26 of 180 ppm and the percentage of oxygen in the stack gases is 10.9%, the corrected CO content corrected to 7% would be equal to $180\times(20.9-7)/(20.9-10.9)$ or 250.2 ppm. The corrected CO content value thus calculated by the module 68 is fed to the recorder 54 and to a comparison module 70 in which the corrected CO content is compared with an allowable limit $L_a$, or the carbon monoxide limit predetermined by regulation, for example. If the corrected CO content is within the allowable limit $L_a$, no further action is taken in terms of adjusting the draft set point generator 58.

If the corrected CO content is above the allowable limit $L_a$, a signal representative of the excessive amount is fed from the comparison module 70, through a timer/buffer or averager 72 to a draft trim module 74. The timer/buffer 72 is activated in response to the detection of excess CO and when so activated, accumulates the excess CO level signals from the comparator 70 for a limited period of time on the order of several seconds to stabilize instantaneous variations in the signal.

In the draft trim module 74, the measured oxygen content of exhaust gases in the stack 26, preferably in percent, is compared with an "ideal" oxygen percentage. The ideal oxygen percentage is largely an empirical value determined by experience with a given processing apparatus and fuel burning efficiency of the burner 18. Because of the requirement for gas flow through the entire plant, the ideal oxygen percentage in the stack 26 is likely to be higher than a percentage reflecting fuel burning efficiency alone. For example, the ideal percentage may account for a measure of tramp air leakage into the flow of gases to the stack 26 because such leakage, though desirably kept at a minimum, is known to exist.

If the corrected carbon monoxide content is above the allowable limit $L_a$ and the percentage oxygen in the stack 26 is above the ideal percentage, it is assumed that the high carbon monoxide content of gases in the stack 26 is a result of excessive draft air and combustion quenching of fuel directed into the drum 12 from the burner 18. The draft set point generator is thus adjusted to reduce the draft set point for the particular burning fire rate to which the burner is set. This procedure is continued until the quantity of carbon monoxide in the stack 26 is brought within the allowable limit $L_a$.

If the percentage oxygen in the stack 26 is less than the ideal percentage, it is assumed that the amount of air supplied by the draft fan 22 is less than that required for complete combustion of burner fuel. Accordingly the draft set point for the burner firing rate at that time is increased to open the damper 44.

In the case where a total air burner is being monitored the burner damper may be controlled along with the exhaust fan damper 44.

The sensors 46 and 48, the modules 68 and 70 and the recorder 54 are turned on and thus in an operating state at all times during operation of the apparatus 10. As a result, the recorder 54 will provide a permanent and complete record of measured CO and $O_2$ levels in the stack 26 and of the corrected CO content calculated by the module 68. Such information is extremely valuable for purposes of assuring proper maintenance of the apparatus 10 and for evidencing compliance or non-compliance with regulations applicable to the operation of such apparatus.

Similarly, the draft trim module 74 will operate continuously to trim the draft set point whenever as the carbon monoxide content in the stack gases is above the allowable limit. If the carbon monoxide content is not corrected by so modulating the draft set point, the operator of the plant is made aware of a defect in the operating components of the plant. For example, excessive air leakage between the drum 12 and the draft fan 22 would increase the oxygen content of the stack gases and may affect the combustion of fuel emanating from the burner 18 in a manner so that draft set point variation under the control of the module 74 will not reduce sensed carbon monoxide to within acceptable limits. Correspondingly, a blockage of the exhaust system between the drum and the fan 22 would reduce the oxygen content of the stack gases and perhaps also result in a signal from the draft sensor 38 calling for a draft increase beyond the trim limits of the system, again diminishing control of stack gas carbon monoxide content. In either case, continued operation of the plant at excessive carbon monoxide levels would indicate a need to discontinue plant operation and to repair components in the apparatus causing the problem.

It will be apparent to those skilled in the art that various modifications and variations can be made in the method and apparatus of the present invention without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. The method for processing material in which the combustion products of fuel supplied to a burner are drawn by induced draft into heat exchange relation with the material being processed and exhausted as stack gases, the rate of fuel supply to the burner being determined by a burner set point corresponding to heat required for processing the material, said method comprising the steps of:

modulating the burner set point as required for processing the material;

monitoring the oxygen content of the stack gases;

monitoring the air pollutant content of the stack gases in relation to the monitored oxygen content; and varying the draft between minimum and maximum values for a given burner set point when the air pollutant content of the stack gases exceeds a predetermined maximum limit.

2. The method recited in claim 1 wherein the monitored air pollutant is combustible.

3. The method recited in claim 2 wherein said step of monitoring the air pollutant content comprises determining the air pollutant content of the stack gases in relation to a predetermined oxygen level and comparing the determined air pollutant content with said predetermined maximum limit.

4. The method recited in either of claims 2 or 3 wherein said step of monitoring the oxygen content comprises comparing the oxygen content of the stack gases with an ideal content for material processing efficiency.

5. The method recited in claim 4 wherein said step of varying the draft comprises increasing the draft when the oxygen content is less than the ideal content and decreasing the draft when the oxygen content exceeds the ideal content.

6. The method recited in claim 1 wherein the monitored air pollutant is carbon monoxide (CO).

7. The method recited in claim 6 wherein said step of monitoring oxygen comprises measuring the percentage of oxygen in the stack gases and wherein said step of monitoring the CO content comprises measuring the CO content in units of parts per million in the stack gases and calculating a corrected CO content referenced to predetermined oxygen percentage.

8. In a material processing apparatus having a burner supplied with fuel and air, means to establish an open chamber through which material to be processed is passed into contact with a flame of combustion products extending into said chamber from said burner, a draft exhaust system for maintaining said chamber under a negative pressure adequate to ensure a continuous flow of gas through said chamber and to discharge to the atmosphere, as stack gases, the products of fuel combustion and other gaseous materials, the improvement comprising:

means for measuring the percent oxygen in said stack gases;

means for measuring the carbon monoxide content of said stack gases in reference to the percent oxygen in said stack gases; and means for varying the draft of said exhaust gas system to maintain the carbon monoxide content within a predetermined maximum level and to obtain maximum combustion efficiency of fuel supplied to said burner, said means for varying the draft of said exhaust system comprising:

means for correcting the measured carbon monoxide content in reference to a predetermined stack gas oxygen percentage to obtain a corrected CO content;

means for determining when said corrected CO content exceeds a predetermined maximum allowable CO content; and means for trimming said draft to reduce the CO content in said stack gases when said corrected CO content exceeds said predetermined maximum allowable CO content in response to deviation of the measured oxygen percentage from an ideal percentage.

9. The material processing apparatus recited in claim 8 wherein said means for trimming said draft increases said draft when the measured oxygen content is less than said ideal percentage and decreases said draft when the measured oxygen content is higher than said ideal percentage.

10. In a material processing apparatus having a burner supplied with fuel and air, the air supplied to said burner being less than that required for complete combustion of said fuel, means to establish an open chamber through which material to be processed is passed into contact with a flame of combustion products extending into said chamber from said burner, a draft exhaust system for maintaining said chamber under a negative pressure adequate to ensure a continuous flow of gas through said chamber and to discharge to the atmosphere, as stack gases, the products of fuel combustion and other gaseous materials, the improvement comprising:

means for measuring the percent oxygen in said stack gases;

means for measuring the carbon monoxide content of said stack gases in reference to the percent oxygen in said stack gases; and means for varying the draft of said exhaust gas system to maintain the carbon monoxide content within a predetermined maximum level and to obtain maximum combustion efficiency of fuel supplied to said burner, wherein said means for varying the draft of said exhaust system operates to draw into said chamber, the remainder of air needed for complete combustion of fuel.

11. In a material processing apparatus having a burner supplied with fuel and air, means to establish an open chamber through which material to be processed is passed into contact with a flame of combustion products extending into said chamber from said burner, a draft exhaust system for maintaining said chamber under a negative pressure adequate to ensure a continuous flow of gas through said chamber and to discharge to the atmosphere, as stack gases, the products of fuel combustion and other gaseous materials, the improvement comprising:

means for measuring the percent oxygen in said stack gases;

means for measuring the carbon monoxide content of said stack gases in reference to the percent oxygen in said stack gases;

means for varying the draft of said exhaust gas system to maintain the carbon monoxide content within a predetermined maximum level and to obtain maximum combustion efficiency of fuel supplied to said burner; and means defining a leakage source of tramp air between said chamber and said draft exhaust system, said means for varying the draft of said exhaust system operating to minimize the leakage of tramp air into said exhaust system.

* * * * *